US005117459A

United States Patent [19]

McShane

[11] Patent Number: 5,117,459

[45] Date of Patent: May 26, 1992

[54] AMBIENT IMAGING LOUDSPEAKER SYSTEM

[75] Inventor: Charles L. McShane, Mt. Prospect, Ill.

[73] Assignee: Chicago Steel Rule Die & Fabricators Co., Illinois, Ill.

[21] Appl. No.: 518,171

[22] Filed: May 3, 1990

[51] Int. Cl.[5] ..... H04R 5/02

[52] U.S. Cl. ..... 381/24

[58] Field of Search ..... 381/1, 24, 88, 89, 90, 381/188, 205

[56] References Cited

U.S. PATENT DOCUMENTS

| | | | |
|---|---|---|---|
| 3,588,355 | 6/1971 | Holm | 381/24 |
| 4,418,243 | 11/1983 | Fixler | 381/24 |
| 4,489,432 | 12/1984 | Polk | 381/24 |
| 4,503,553 | 3/1985 | Davis | 381/24 |
| 4,569,074 | 2/1986 | Polk | 381/24 |
| 4,586,192 | 4/1986 | Arntson | 381/24 |
| 4,630,298 | 12/1986 | Polk et al. | 381/1 |
| 4,748,669 | 5/1988 | Klayman | 381/1 |
| 4,759,066 | 7/1988 | Polk et al. | 381/24 |
| 4,819,269 | 4/1989 | Klayman | 381/86 |
| 4,847,904 | 7/1989 | McShane | 381/24 |
| 4,888,804 | 12/1989 | Gervert | 381/24 |

OTHER PUBLICATIONS

A Psychoacoustically Optimized Loudspeaker, Kantor et al. Journal of Audio Engineering Soc., vol. 34, No. 12, pp. 990–996 Dec., 1986.

*Primary Examiner*—Forester W. Isen

*Attorney, Agent, or Firm*—Trexler, Bushnell, Giangiorgi & Blackstone, Ltd.

[57] ABSTRACT

Sound reproduction apparatus includes a loudspeaker system having a plurality of drivers for producing audio signals in response to respective electrical right and left stereophonic signals. A first of these drivers has a voice coil wired and connected in circuit for producing an audio output signal representing one of the electrical right and left stereophonic signals. A second of these drivers has a dual voice coil wired and connected in circuit for producing an audio output signal representing a difference between the one of the electrical right and left stereophonic signals reproduced by the first driver and the other stereophonic signal.

6 Claims, 2 Drawing Sheets

AMBIENT IMAGING LOUDSPEAKER SYSTEM

BACKGROUND OF THE INVENTION

This invention relates to improvements in sound reproduction, and particularly to an improved loudspeaker system for providing improved ambient imaging, as well as improved image location, without regard to listener position relative to a pair of said loudspeaker systems which are spaced apart and located generally facing the listener.

Loudspeaker systems generally comprise one or more drivers or driver elements (sometimes referred to as speakers), which are arranged within a common cabinet, enclosure or other housing or mounting structure in such a way as to provide a full range of audio frequencies. The drivers or speakers are also often arranged so as to radiate these audio frequencies in a given pattern. In the present description, the term loudspeaker or loudspeaker system will be utilized to refer to an apparatus in which one or more drivers are mounted, arrayed and electrically connected for radiating audio signals in a desired pattern. The term "driver" will be used to refer to the individual "speaker" elements which may be arrayed or mounted in such a loudspeaker system. As such, a driver commonly includes at least one radiating element such as a cone, horn, dome or the like and an electrically driven element such as a voice coil which may contain one or more windings for applying electrical signals thereto, which signals in turn drive the cone or other sound radiating element. In this way, the electrical signals fed to the voice coil or other driven elements are reproduced as sound vibrations by the cone or other radiating element.

Generally speaking, stereophonic sound recordings or broadcasts rely on the spacing of microphones during recording or broadcast for their dimensional content. When respective right and left channel microphones are used in the recording or broadcast, the reproducing of the same left and right information in separate left and right loudspeaker systems can be used to reproduce compatible spatial or ambient characteristics as in the original location of the recording or broadcast. That is, the phase and amplitude differences between what is recorded or reproduced on the left versus the right can cause the ear/brain mechanism to interpret the resulting sound reproduction as having a spatial reality in spite of contributions of the listening room. In customary stereo sound recording and reproduction, respective left and right channels are intended to reproduce corresponding information in the original recording or broadcast such that verbatim physical conditions are not required in the listening room for the ear/brain combination to selectively "tune out" the listening room's time and amplitude information and instead "hear" the spatial and ambience characteristics of the original recorded or broadcast event.

However, for the listener's ear/brain mechanism to be convinced of the spatial ambience of the program, it is necessary that the left and right channel information reach the listener's left and right ears both independently and in a time sequence consistent with the original recording ambient "signature". The impinging listening room ambient "signature" makes the listener instantly aware that he is listening to a reproduction of an original acoustic event and not the event itself.

In addition, acoustic artifacts unique to loudspeakers in rooms create dimensional compression in the lateral plane further diminishing the credibility of the experience. Dimensional compression means that acoustic events occuring at right angles to a listener situated in a concert hall are perceived through loudspeakers as though they were squeezed between the two loudspeakers.

Typically, listeners attempt to regain some of the dimensional impact of the original performance by spacing their loudspeakers as far apart as possible. When this is done the central image and specificity are lost. Individual performers seem to be split into left and right loudspeakers.

The two principal elements in lateral localization of sound are time (phase) and intensity. A louder sound seems closer and a sound arriving later in time seems farther away. The listener will employ the two ears and the perceptive interval between the two ears to establish lateral location. This involves the Pinnar effect, often discussed in terms of "interaural cross-correlation".

In typical prior art speaker system arrangements, a listener is positioned in front of and equidistant from equivolume radiating speakers of a pair of loudspeaker systems. The respective left and right loudspeaker systems produce the right and left stereo channels essentially monophonically. Whatever dimensional quality exists in the experience is created when the listener (who must be equidistant from the left and right loudspeakers) is able to compare the left and right acoustic events through the ear/brain mechanism. It should be noted that this "difference component" exists only between the two loudspeakers and diminishes as the listener approaches either loudspeaker. Independent right ear and left ear perception may be compromised by some left ear perception of the right channel and vice versa. The perception of these interaural effects is in the early arrival time domain, so that the later arrival room reflections do not ameliorate the diminished perceptions of the left and right difference components.

Thus, as a listener moves into a position closer to one loudspeaker system than the other, the effect worsens. The output from the more distant loudspeaker system appears reduced until sound from only the nearer system envelops the listener. Since the stereophonic effect of the recorded or broadcast material depends on the listener's perception of the difference between channels, the reduction of either of these channels tends to further compromise the already interaurally compromised left-right signal.

Accordingly, some listeners have expressed a preference for sound reproduced through stereophonic headphones. These isolate the recorded, time-related ambience by blocking out the impinging ambience of the listening room. They also prevent the slightly delayed arrival of left information at the right ear and vice versa. However, headphones provide limited acoustic performance, principally in the bass region, and generally are confining and somewhat uncomfortable to wear for prolonged periods.

While it may be possible to affect the ear/brain mechanism localizing ability by employing artificial clues such as deliberate phase shifts, the prior art has generally not employed such techniques because no universally accepted first-order model exists. Prior art loudspeakers ignoring both room interaction and recording techniques have concentrated on the loudspeaker as a straight forward power device. Design efforts have been directed at providing the most uniform total radiated power response with a minimum of transducer generated distortion components. This insures that the perceived output may have accurate instrumental timbre, but does not insure that the listener will hear a dimensionally convincing version of the original sound from a wide range of positions in a normal listening room. For most stereophonic reproduction devices, the stereo signals are typically reproduced by a loudspeaker system or apparatus that incorporates a plurality of drivers, usually of different frequency characteristics, mounted in spatially fixed relation to one another in an enclosure. Typically two such enclosures are utilized, the drivers of each enclosure wired to reproduce only the left channel or only the right channel stereophonic signals.

In the past several years, however, efforts have been made to overcome some of the acoustic problems with these types of loudspeaker systems, as discussed above. A number of other prior art patents and their approaches are discussed in the inventor's own prior U.S. Pat. No. 4,847,904, issued Jul. 11, 1989, to which reference is invited.

The aforesaid prior U.S. Pat. No. 4,847,904 teaches an arrangement of drivers in a loudspeaker system including at least one dual-coil driver in each speaker system connected so as to reproduce only the difference between the left and right channels. This patent additionally teaches providing respectively inwardly and outwardly facing drivers in each of respective left and right speaker systems and connecting their respective outwardly facing drivers to produce the left-right difference signals.

In addition, specific polarity relationships between the L-R and R-L outwardly radiating drivers and their respective L and R inward radiating drivers are employed in my prior patent. Specifically, if the L component of the left speaker system inwardly radiating element is deliberately connected in opposing phase to the L component of the R-L outwardly radiating element of the left speaker system, and if the same is done with the R components of the right speaker system, a narrow angle acoustic null is created in the area immediately in front of each speaker system. The width of the null is determined by the precise relative angle of the two drivers and their spacing.

Accordingly, as a listener moves directly in front of either the left or right speaker, the opposite or more distant speaker tends to sound louder. By providing respective difference components (L-R and R-L) on the outboard facing driver of each speaker system, each ear also tends to reject information that normally would travel to the opposite ear from the same channel. The effect is somewhat like wearing headphones or building an acoustic wall to isolate the left and right channels from the respective opposite ears. Hence, in the arrangement taught by my prior patent, the listener in almost any position in the listening room will sense either from direct output from a difference driver, or from reflected images created by room walls, significantly enhanced ambient information.

The nature of the difference (L-R and R-L) components is to emphasize late arrival reflected information. In my prior patent, the relative gain of the inward-outward radiating drivers can be considered infinitely adjustable. However, as the relative gain of the difference drivers is increased relative to the inward L mono or R mono image, specificity can be compromised.

I have now determined, however, that a further improvement in the imaging can be obtained by maintaining the same polarity as between the like components of the inwardly and outwardly radiating drivers of the respective speaker systems. That is, rather than connecting the left component of the R-L element in opposing phase to the left inwardly radiating element, the two should be maintained in the same phase relation. Similarly, instead of connecting the right component of the L-R outwardly radiating element in opposing phase to the right inwardly radiating element of the right speaker system, these two right components should also be connected in phase.

I have further determined that in order to avoid an overly vague central image, the inwardly facing driver of each speaker system, physically arranged generally as taught in my aforementioned prior patent, can provide monophonic information in addition to its normal left or right channel function. This can be done by using a dual voice coil connected L+R or R+L. Such a speaker connected to a stereophonic source will produce only a composite monophonic component. This "in-phase" signal L+R, R+L, tends to narrow the sound stage and produce a more sharply defined center image.

In U.S. Pat. No. 4,748,669 to Klayman, stereo sum and difference components are extensively processed and manipulated in both recording and sound reproduction applications. However, the extensive processing, external additional circuitry and cross-channel amplifier wiring taught by this patent may degrade the audio signal with hum or noise.

In Polk U.S. Pat. No. 4,569,074, a speaker system is employed in which two drivers face in the same direction such that the axes along which the two drivers radiate sound are essentially parallel. These drivers are arranged essentially side by side such that one may be referred to as inboard and the other as outboard. These two drivers are coupled such that in the left system the inboard driver produces only the left stereo component, while the outboard driver produces a left-minus-right (L-R) difference component. In the right speaker system, the inboard driver produces only the right stereo component, while the outboard driver produces an R-L component. While this system produces good imaging for a listener positioned equidistant from the two speaker systems, it fails to produce a satisfactory image for a listener in any other position relative to the speaker systems.

OBJECTS AND SUMMARY OF THE INVENTION

Accordingly, it is a general object of this invention to provide a novel and improved ambient imaging loudspeaker system which, when utilized in left and right pairs, conveys an enhanced sense of ambience and a definite center soundstage image, substantially without regard to the position of a listener in the listening room.

Briefly, in accordance with the foregoing object, sound reproduction apparatus in accordance with the invention comprises a loudspeaker system including a plurality of drivers for producing audio signals in response to respective electrical right and left stereophonic signals; a first of said plurality of said drivers having a voice coil wired and connected in circuit for producing an audio output representing one of said electrical right and left stereophonic signals; and a second of said drivers having a dual voice coil wired and connected in circuit for producing an audio output representing a difference between said one of said electrical right and left stereophonic signals and the other of said electrical right and left stereophonic signals, and mounting means for mounting said drivers to radiate sound along divergent axes.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawings in which like reference numerals identify like elements, and in which:

DETAILED DESCRIPTION OF THE ILLUSTRATED EMBODIMENT

Figure 1:
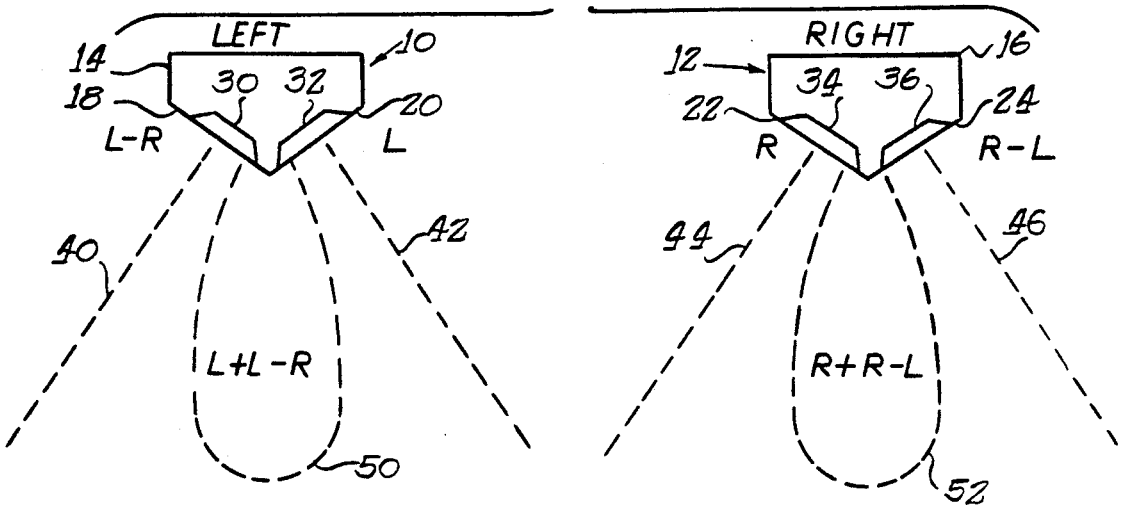
FIG. 1 is a top plan view, somewhat diagrammatic in form, of a pair of speaker systems employing driver components wired and spatially arranged in accordance with the invention.

Referring now to the drawings, and initially to FIG. 1, a pair of loudspeaker systems 10, 12, constructed in accordance with the invention, are illustrated in somewhat diagrammatic form. Generally speaking, each of these loudspeaker systems 10, 12 includes an enclosure 14, 16 having a front portion comprised of a pair of flat, vertical panels 18, 20 and 22, 24 which are arranged for receiving or mounting first and second drivers or driver elements 30, 32 and 34, 36. These generally flat, vertical panels mount the respective drivers for radiating or directing sounds along respective divergent first and second axes indicated by phantom lines 40, 42 and 44, 46. The included angle between these axes is preferably between 60° to 90°. Conversely, the flat vertical panels 18, 20 and 22, 24 define planes arranged at an angle which is the supplementary angle of the angle defined between these radiating axes 40, 42, and 44, 46.

In accordance with an important feature of the invention, one of the drivers in each of these loudspeaker systems 10, 12 has a dual voice coil wired and connected in circuit for producing an audio output signal representing a difference between electrical right and left stereophonic signals. Further details of this wiring and circuit connection of the voice coils will be described hereinbelow with reference to FIG. 2. In accordance with the invention, a second of the drivers in each loudspeaker system 10, 12 has a voice coil wired and connected in circuit for producing an audio output signal representing only one of the electrical right and left stereophonic signals.

Accordingly, in the diagram of FIG. 1, each of the drivers has been additionally designated by symbols which indicate its audio output signal as representing either only one of, or a difference between the electrical right and left stereophonic signals. Specifically, in system 10, driver 30 is designated as L-R, while driver 32 is designated L. Similarly, in loudspeaker system 12, the driver 34 is designated R and driver 36 is designated R-L.

Figure 2:
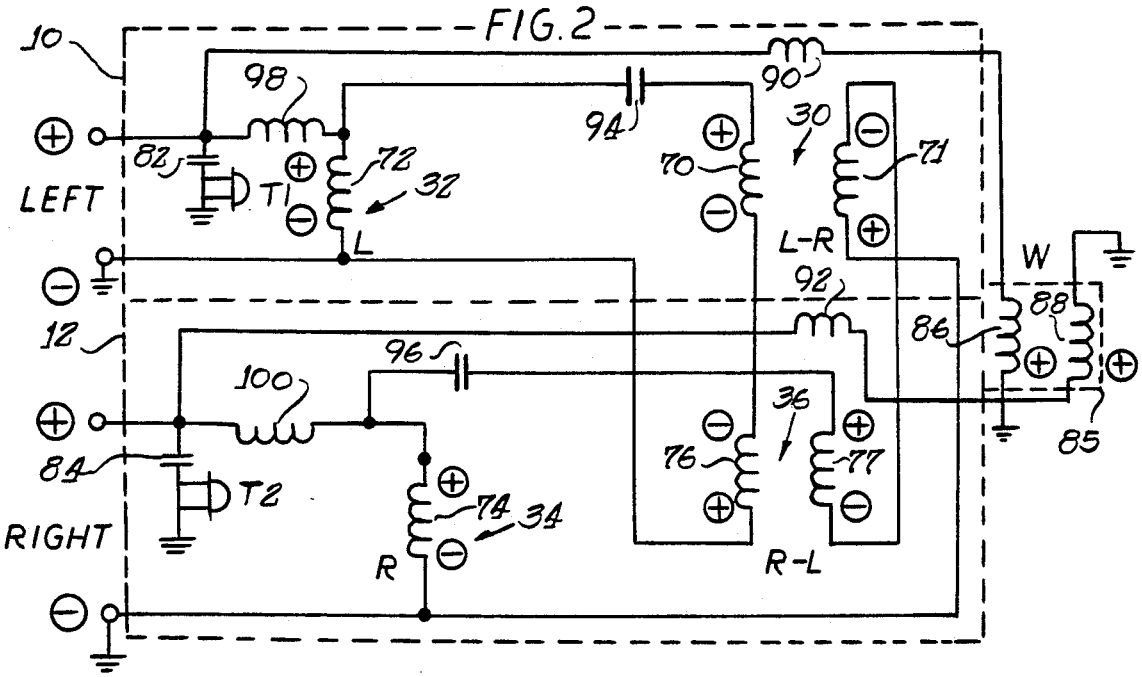
FIG. 2 is a schematic wiring diagram illustrating the connection among the driver coils of the drivers of the systems of FIG. 1.

The wiring for the speaker systems 10, 12 is indicated in further detail in FIG. 2. This wiring and connection of the respective speakers and the mounting thereof at predetermined relative angles in the respective speaker systems 10, 12 creates what we will term an acoustical "difference" area diagrammatically indicated in areas 50 and 52 in front of the respective loudspeakers systems 10, 12. Hence, as a listener moves directly in front of either the left or the right speaker, difference information continues to be presented, enabling the listener to perceive a more accurate image of the originally recorded or transmitted information, that is, a more accurate reconstruction of the original recording ambient "signature".

For example, a listener positioned in the area 50 hears generally the left and the L-R information from drivers 30, 32 and also somewhat diminished right information from the driver 34 located a somewhat greater distance away, but angled somewhat in the direction of the area 50. The R-L information is perceived only as reflected information from room surfaces. A similar effect takes place in area 52, with the R+R-L information being perceived in addition to somewhat diminished left information from driver 32, due to its angle generally in the direction of area 52. A listener generally centered between the speaker systems 10 and 12 perceives the left and right channel more or less directly and both reflected and direct L-R and R-L information. A listener positioned generally in front of outboard driver 36 hears a diminished right component similar to the listener in area 50, but a more pronounced left component. Similarly, a listener positioned in front of driver 30 hears a somewhat diminished left component similar to the listener in area 52, but the right contribution is somewhat stronger.

Referring to FIG. 2, an exemplary wiring diagram for accomplishing the arrangement of speaker connections to the left and right channels, as indicated in FIG. 1 is illustrated. Respective drivers 30 and 32 of the left loudspeaker system 10 and the drivers 34, 36 of the right loudspeaker system 12 are represented diagrammatically by their respective voice coils. Accordingly, driver 30 of the left speaker system 10 has dual voice coils 70 and 71 which are wired to produce an audio signal corresponding to the difference L-R between the left and right stereophonic channels. The inwardly facing driver 32 has a single voice coil 72 wired to produce only the left channel signal. Similarly, the outwardly facing driver 36 of the right loudspeaker system 12 had dual voice coils 76, 77 wired to produce an audio output corresponding to the difference R-L between the right and left stereo signals.The inwardly facing driver 34 of this system 12 has a single voice coil 74 wired to produce only the right stereophonic channel or signal.

In the embodiment illustrated in FIG. 2, I have also shown an additional bass or woofer loudspeaker or driver W and a pair of additional high-frequency or tweeter drivers T1 and T2. The woofer W may have its own enclosure 85. Tweeters T1, T2 may be mounted to the same surfaces 20, 22 as L and R drivers 32, 34. FIG. 2 also illustrates the preferred location of the components thereof when configured as the two speaker systems 10, 12 of FIG. 1.

The respective tweeter drivers are wired directly to produce the left and right stereophonic signals with suitable high-pass filtering, for example, in the form of capacitors 82, 84. The low frequency or woofer driver is preferably a dual voice coil driver similar to drivers 30 and 36; that is, having dual voice coils 86, 88. Voice coil 86 is wired to receive the left stereophonic signal, while voice coil 88 is wired to receive the right stereophonic signal. Additional low-pass filters, preferably in the form of conductors or coils 90, 92 are also placed in series with the respective voice coils 86, 88. In the embodiment illustrated in FIG. 2, the respective voice coils 70, 76 and 71, 77 also have their signals subjected to a suitable amount of high-pass filtering by the insertion of respective series capacitors 94, 96. Moreover, additional inductors or coils 98, 100 are also wired in series in respective lines leading to voice coils 70 and 72, and 74, and 77 as illustrated. This accomplishes suitable low-pass filtering as to the drivers 32 and 34 and, when combined with high-pass filter capacitors 94 and 96, provides a band-pass to the voice coils of drivers 30 and 36. A suitable interconnect cable may be used to provide the necessary connections between left speaker system 10 and right speaker system 12.

Figure 5:
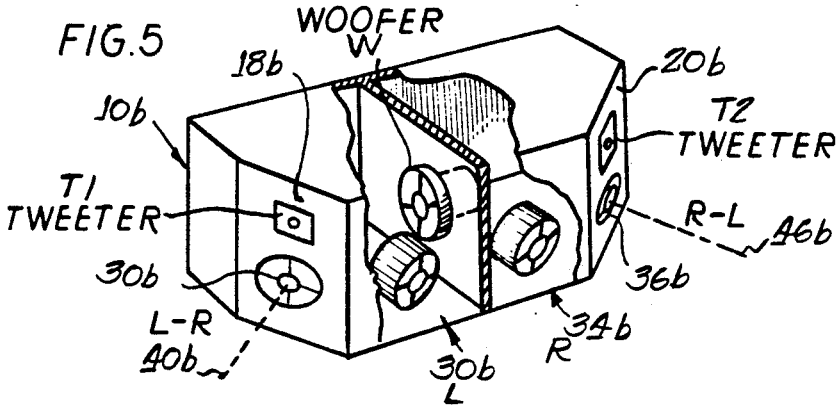
FIG. 5 is a perspective view of an ambient imaging loudspeaker apparatus in accordance with the invention employing a single cabinet.

It is also contemplated that the drivers illustrated in the circuit schematic of FIG. 2 may all be placed in a single cabinet to form a complete ambient imaging speaker system in a single enclosure. A diagrammatic view of one such suitable enclosure is indicated in FIG. 5, which will be described in further detail below.

Figure 3:
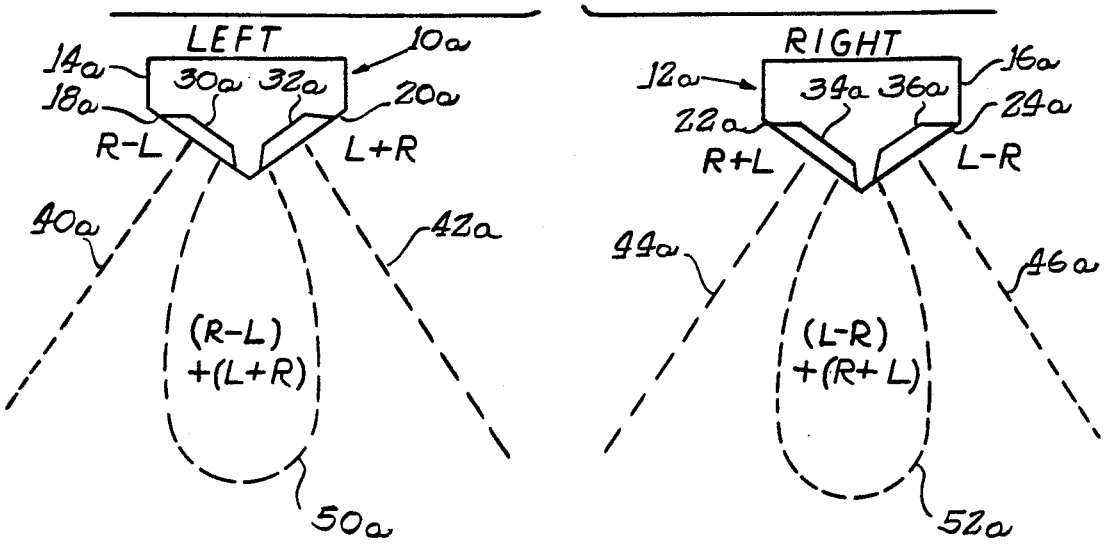
FIG. 3 is a top plan view similar to FIG. 1 and showing a second embodiment.
Figure 4:
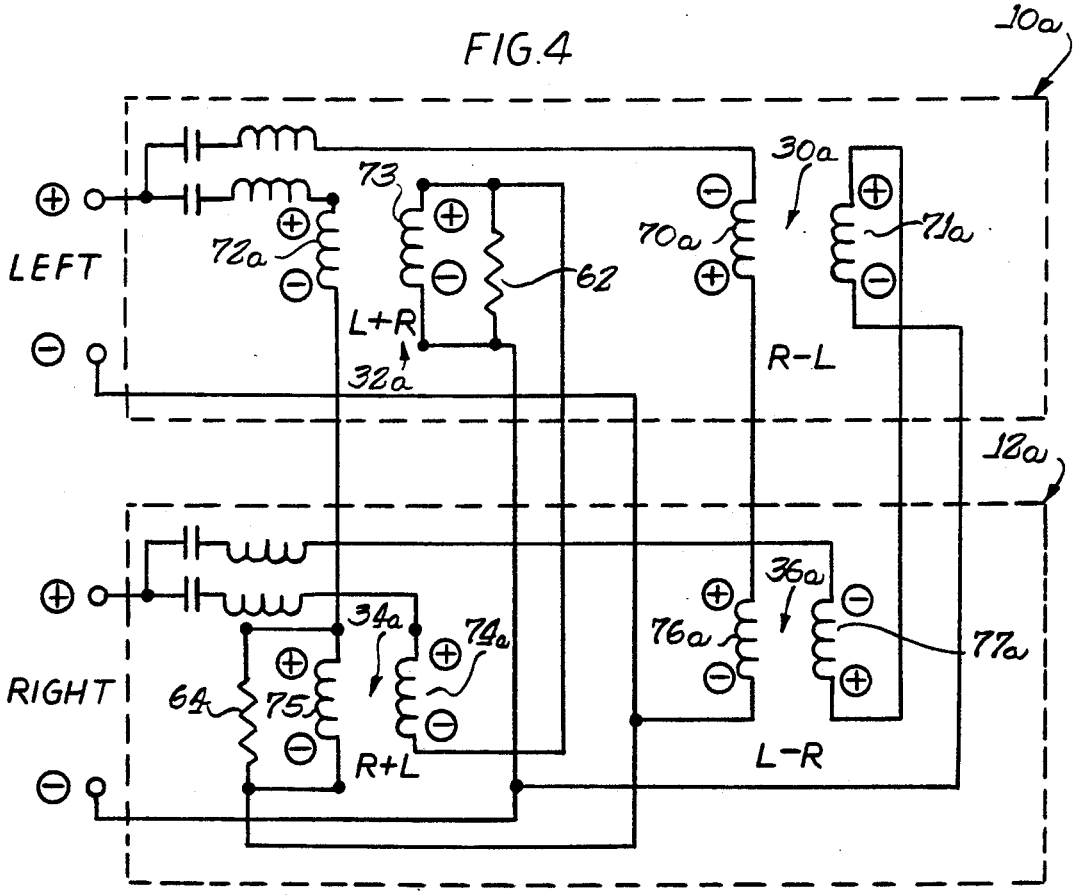
FIG. 4 is a schematic wiring diagram of the second embodiment.

Referring now to FIGS. 3 and 4, a second embodiment of sound reproduction apparatus in accordance with another form of the invention is illustrated. In the embodiment of FIGS. 3 and 4, elements similar to those described above with reference to FIGS. 1 and 2 have been designated by like reference numerals together with the suffix a.

Thus, in similar fashion to the embodiment of FIG. 1, the apparatus employs a pair of loudspeaker systems 10*a*, 12*a*, each having an enclosure 14*a*, 16*a*, having front portions 18*a*, 20*a*, and 22*a*, 24*a* arranged at an angle for mounting first and second drivers or driver elements 30*a*, 32*a*, and 34*a*, 36*a*. The panels are arranged for mounting the respective drivers for directing sounds along divergent first and second axes indicated by the phantom lines 40*a*, 42*a*, and 44*a*, 46*a*. The included angle between these axes is preferably between 60°-90°. Similarly, the panels upon which the drivers are mounted are arranged at an angle which is the supplementary angle of this angle defined between the radiating axes.

Departing from the embodiment of FIGS. 1 and 2, both of the drivers 30*a*, 32*a*, and 34*a*, 36*a* and the respective systems 10*a*, 12*a* employ dual voice coils. The inboard facing drivers 32*a* and 34*a* are wired and connected in circuit for producing an audio output signal representing a sum of the electrical right and left stereophonic signals. The outboard facing drivers 30*a* and 36*a* are wired and connected in circuit for producing an audio output signal representing a difference between the electrical right and left stereophonic signals. Preferably, the outboard facing driver 30*a* of the left system 14*a* is wired to produce the difference R-L, while the outboard driver 36*a* of the right system 12*a*, is wired to produce the difference L-R.

As indicated in FIG. 3, the above-described wiring and connection of the speakers and the mounting thereof at a predetermined angle creates a partial acoustic "null" area, diagrammatically indicated at 50*a* and 52*a* in front of the respective loudspeaker systems 10*a*, 12*a*. As a listener moves directly in front of either the left or right speaker, the opposite or more distant speaker tends to sound louder. It will be seen that in the null area 50*a*, the left channel signals tend to cancel out such that the right channel is dominant. Conversely, in the null area 52*a*, in front of the right loudspeaker system 12*a*, the right channel tends to cancel out such that the left channel is dominant.

On the other hand, a listener at a position roughly equidistant from both the left and right loudspeaker systems 10*a*, 12*a* will tend to hear both the left and right speakers with both ears. Thus, by providing the difference (L-R and R-L) components on the outboard or outwardly facing or directed "difference" drivers 30*a*, 36*a*, each ear will reject the information that normally would travel to the opposite ear from the same channel. This effect, and the foregoing arrangement of the "difference" drivers 30*a*, 36*a* for achieving the same, is discussed at further length in my above-mentioned prior U.S. patent, to which further reference is invited.

However, the wiring of the inboard or inwardly facing drivers 32*a*, 34*a* to produce the sum signals, greatly strengthens the central image. By using a dual voice coil, drivers 32*a* and 34*a*, when connected to a stereophonic source, reproduce a composite monophonic component. It is known that when left and right stereophonic speaker systems are operated entirely in a monophonic mode, the apparent image of the sound source is located more or less centered between the physical placement of the two speaker systems.

My experiments have further shown that when an attenuated L+R or R+L component is superimposed upon the individual Left and Right monophonic outputs, the central image is greatly clarified. This permits a greater output of the difference L-R, R-L, outwardly radiating drivers without compromising the specificity and sharpness of the central image.

Referring now more specifically to FIG. 4, a preferred form of circuit and wiring diagram for achieving the above-described connections to the drivers of speaker systems 10*a*, 12*a* is illustrated in circuit schematic form. The wiring of the inboard or inwardly facing drivers 32*a*, 34*a* produces an attenuated sum mono (i.e., L+R or R+L) signal in addition to the L mono and R mono. The amount of attenuation is controlled by the choice of the values of resistors 62 and 64.

The voice coils of driver 30*a* are designated in FIG. 4 by reference numerals 70*a* and 71*a*. Similarly, the voice coils of driver 32*a* are designated 72*a* and 73. The voice coils of driver 34*a* are designated 74*a* and 75, while the voice coils of driver 36*a* are designated as 76*a* and 77*a*.

Additionally, as mentioned above, the circuit of FIG. 4 comprises a cross-over network for producing the respective sum and difference signals. In order to achieve the desired result, I prefer to attenuate just the inphase component from the opposite channel. This results in the desired addition of an L+R (or R+L) mono signal with the L mono signal (or R mono signal) at each driver.

As also mentioned above, in accordance with my experimental findings, the attenuation or filtering of the in-phase component for the sum signals at drivers 32*a* and 34*a* is preferably on the order of 6 db. That is, the in-phase component from the opposite channel is attenuated by 6 db in accordance with a preferred form of the invention. I have determined experimentally that this is approximately an optimum amount of attenuation for the desired effect.

In the circuit diagram of FIG. 4, these attenuator resistors are indicated by reference numerals 62 and 64, respectively. Hence, it will be seen that with respect to voice coils 72*a*, 73, that the voice coil 72*a* receives the left stereophonic signal, while the voice coil 73 receives the right stereophonic signal in phase with the left signal but attenuated by 6 db by the resistor 62. Similarly, the driver 34*a* has its first voice coil 74*a* wired to receive the right stereo signal and its second voice coil 75 wired to receive the left signal in phase therewith but attenuated by 6 db by the resistor 64. It will be seen that equal amplitude right and left signals are fed to the respective voice coils 76*a*, 77*a* and 70*a*, 71*a*. However, these voice coils are wired out of phase to produce the corresponding difference signals L-R and R-L.

Referring briefly to FIG. 5, it is also within the scope of the invention to place all of the drivers and associated circuitry indicated in FIG. 2 in a single enclosure 10*b*. In the single enclosure embodiment of FIG. 5, like components to the embodiment of FIGS. 1 and 2 are indicated by like reference numerals together with the suffix b. Accordingly, the enclosure 10*b* of FIG. 5 mounts one of the tweeters T1 and the L-R difference driver 30*b* generally at an outwardly angled left-hand side surface or panel 18*b* of the enclosure. Thus the axis of radiation of speaker 30*b* is indicated generally by reference numeral 40*b*. Similarly, the second tweeter T2 and the R-L difference speaker 36*b* are mounted in an oppositely outwardly angled side panel 20*b* of the enclosure 10*b*. Generally speaking, the relative angle between the panels or walls 18*b* and 20*b* of the enclosure are such that axis 40*b* and a similar axis of radiation 46*b* of speaker 36*b* generally define an angle therebetween of from on the order of 60° to on the order of 90°.

In the single enclosure embodiment of FIG. 5, the remaining right and left channel drivers 32*b* and 34*b* are mounted in a generally forwardly facing wall or panel of the enclosure with the left driver 32*b* generally to the left of right driver 34*b*. The left driver receives the L channel signal only, and the right driver receives the R channel only. The woofer W, if a woofer is desired in the system, may be mounted in any desired orientation in the enclosure. However, it has here been illustrated as being mounted internally of the enclosure, it being understood that suitable baffling and suitable vented ports, passive radiators, or other means for accomplishing the desired acoustical relationships of the drivers to each other and to the enclosure and desired radiation of the sound outwardly of enclosure 10*b*, may be provided without departing from the invention.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. Sound reproduction apparatus comprising: a loudspeaker system including a plurality of drivers for producing audio signals in response to respective electrical right and left stereophonic signals from respective signal sources; a first of said plurality of said drivers having a first voice coil wired and connected in circuit for producing an audio output representing one of said electrical right and left stereophonic signals; and a second of said drivers having a dual voice coil wired and connected in circuit for producing an audio output representing a combination of said one of said electrical right and left stereophonic signals, in phase with said first voice coil, and the other of said electrical right and a left stereophonic signals out of phase with its source; and mounting means for mounting said first and second drivers for radiating sound along respective divergent axes; a second loudspeaker system comprising a plurality of drivers, a first of said drivers of said second loudspeaker system having a first voice coil wired and connected for producing an audio output representing the other of said electrical right and left stereophonic signals; and a second of said drivers in said second loudspeaker system having a dual voice coil wired and connected for producing an audio output representing a combination of said other of the electrical right and left stereophonic signals, in phase with said first voice coil of said second system, and said one of said electrical right and left stereophonic signals out of phase with said first voice coil of said first system, and wherein said second loudspeaker system includes mounting means for mounting said first and second drivers thereof for radiating sound along respective divergent axes; and wherein said mounting means are configured such that, when the loudspeaker systems are placed side-by-side, the audio outputs produced by said first voice coils are directed along axes which converge and the audio outputs produced by said dual voice coils are directed along axes which diverge.

2. Apparatus according to claim 1 and wherein each said loudspeaker system further includes a crossover network for producing signals corresponding respectively to said combinations of said electrical right and left stereophonic signals, and each system further including means for frequency filtering one of said left and right stereophonic signals.

3. Apparatus according to claim 1 wherein said divergent axes define an included angle between approximately 60° and approximately 90°.

4. Apparatus according to claim 3 wherein said mounting means of said first and second loudspeaker systems each comprises enclosure means having a front portion comprised of a pair of flat, vertical panels arranged for receiving said first and second drivers, and defining planes arranged at an angle, which is the supplementary angle of the angle defined between the radiating axes of said drivers.

5. Sound reproduction apparatus comprising: a loudspeaker system including a single enclosure which houses a plurality of drivers for producing audio signals in response to respective electrical right and left stereophonic signals; a first of said plurality of drivers having a voice coil wired and connected in circuit for producing an audio output representing one of said electrical right and left stereophonic signals; and a second of said drivers having a dual voice coil wired and connected in circuit for producing an audio output representing a difference between said one of said electrical right and left stereophonic signals, and the other of said electrical right and left stereophonic signals; and mounting means for mounting said first and second drivers for radiating sound along respective divergent axes; a third of said drivers having a voice coil wired and connected for producing an audio output representing the other of said electrical right and left stereophonic signals; and a fourth of said drivers having a dual voice coil wired and connected for producing an audio output representing a difference between said other of the electrical right and left stereophonic signals and said one of said electrical right and left stereophonic signals; and mounting means for mounting said third and fourth drivers thereof for radiating sound along respective divergent axes; wherein said mounting means mounts said first and said third drivers for radiating sound in the same direction along parallel axes.

6. Sound reproduction apparatus comprising: respective left and right enclosures, each of which houses a plurality of drivers for producing audio signals in response to respective electrical right and left stereophonic signals; a first of said plurality of driver being housed in said left enclosure and having a voice coil wired and connected in circuit for producing an audio output representing said electrical left stereophonic signal; and a second of said drivers being housed in said left enclosure and having a dual voice coil wired and connected in circuit for producing an audio output representing a difference between said electrical left nd right stereophonic signals; and mounting means for mounting said first and second drivers for radiating source along respective divergent axes; a third of said drivers being housed in said right enclosure and having a voice coil wired and connected for producing an audio output representing said electrical right stereophonic signal; and a fourth of said drivers being housed in said right enclosure and having a dual voice coil wired and connected for producing an audio output representing a difference between said electrical right and left stereophonic signals; and mounting means for mounting said third and fourth drivers for radiating sound along respective divergent axes; and wherein said mounting means are configured such that, the audio outputs of said first voice coils are directed along axes which converge and the audio outputs produced by said dual voice coils are directed along axes which diverge.

* * * * *

UNITED STATES PATENT AND TRADEMARK OFFICE

CERTIFICATE OF CORRECTION

PATENT NO. : 5,117,459

DATED : May 26, 1992

INVENTOR(S) : Charles L. McShane

It is certified that error appears in the above-identified patent and that said Letters Patent is hereby corrected as shown below:

Column 12 Line 7 "electrical left nd" should be

--electrical left and--

Column 12 Line 9-10 "radiating source" should be

--radiating sound--

Signed and Sealed this

Thirty-first Day of August, 1993

Bruce Lehman

*Attest:*

BRUCE LEHMAN

*Attesting Officer*

*Commissioner of Patents and Trademarks*